United States Patent [19]

Pemrick et al.

[11] Patent Number: 4,725,487

[45] Date of Patent: Feb. 16, 1988

[54] FLEXIBLE COATED ABRASIVE AND FABRIC THEREFOR

[75] Inventors: Raymond E. Pemrick, Schenectady; Dhiraj H. Darjee, Ballston Lake, both of N.Y.

[73] Assignee: Norton Company, Worcester, Mass.

[21] Appl. No.: 845,897

[22] Filed: Mar. 28, 1986

[51] Int. Cl.[4] ..... B05D 5/00

[52] U.S. Cl. ..... 428/240; 428/283; 428/253; 66/192

[58] Field of Search ..... 66/192, 193, 202, 196; 428/240, 283, 253

[56] References Cited

U.S. PATENT DOCUMENTS

| | | | |
|---|---|---|---|
| 2,890,579 | 6/1959 | Mauersberger | 66/192 |
| 4,350,727 | 9/1982 | Wald et al. | 428/240 X |
| 4,386,943 | 6/1983 | Gümbel et al. | 428/240 |
| 4,608,290 | 8/1986 | Schnegg | 66/84 A |
| 4,692,365 | 9/1987 | Kratzsch et al. | 428/240 X |

FOREIGN PATENT DOCUMENTS

| | | | |
|---|---|---|---|
| 677833 | 1/1964 | Canada | 428/240 |
| 1585047 | 11/1969 | Fed. Rep. of Germany | 66/190 |

*Primary Examiner*—Ronald Feldbaum
*Attorney, Agent, or Firm*—Frank S. Chow; Norvell E. Wisdom, Jr.

[57] ABSTRACT

Flexible coated abrasives with facile straight tear in either the length or cross directions can be made on stitch bonded fabric backings having (1) an aral density between 51 and 153 gm/m$^2$, (2) a tensile strength in the length direction between 5.4 and 12.6 kN/m of width, (3) a tensile strength in the cross direction which is between 5.4 and 11.7 kN/m of length and is between 0.9 and 1.35 times as great as the length direction tensile strength, (4) an elongation to break in the length direction of not more than 40%, and (5) an elongation to break in the cross direction of not more than 35%. The fabric is prepared for coating by saturation with at least its own weight of a finishing adhesive composed primarily of latices of acrylic homopolymers, acrylic copolymers, butadienestyrene polymers, or mixtures of these types. Conventional making, grit coating, and sizing are then performed to yield a coated abrasive with a ratio of length direction tensile modulus to cross direction tensile modulus within the range of 0.8 to 1.8.

20 Claims, 5 Drawing Figures

FIG. 2-A
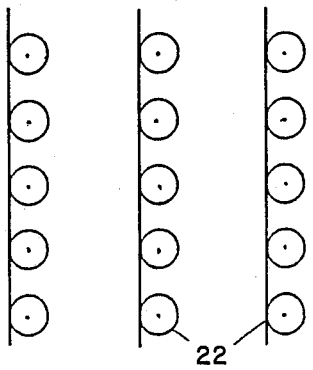
FIG. 2-B
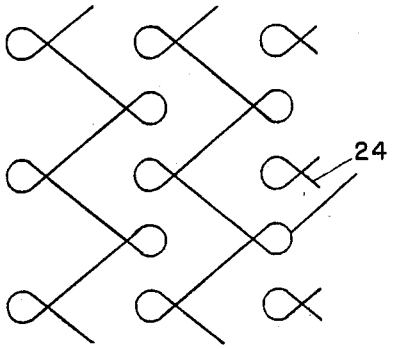
FIG. 2-C
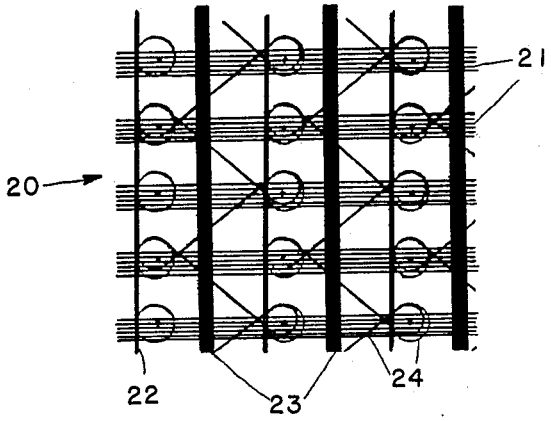

FLEXIBLE COATED ABRASIVE AND FABRIC THEREFOR

BACKGROUND OF THE INVENTION

1. Field of the Invention

This invention relates to the general field of coated abrasives and particularly to the type of such abrasives which have exceptionally flexible backings and which can readily be torn by hand to yield a reasonably straight torn edge. The invention also relates to the field of stitch bonded fabrics, which are a major component of the backings of the coated abrasives of the invention.

2. Description of the Prior Art

Before 1974, almost all coated abrasive cloth products were coated on woven cotton cloth, and it was common knowledge among manufacturers and users of coated abrasives that such products could usually be torn carefully by hand in such a way as to produce a substantially straight and unpuckered edge. This property of straight tear is particularly advantageous to users who can not always forecast in advance just what width of coated abrasive they will need at any given time and therefore prefer to buy relatively wide rolls of coated abrasive cloth and tear it to width as needed. While straight tearing capability along lines parallel to the machine direction of the cloth is most common, some products also will tear straight in the cross direction. These are particularly convenient to those who use coated abrasives without the aid of mechanical driving devices and often want to sand workpieces with small concave radii of curvature or small dimensions generally.

The introduction of polyester cloth for coated abrasive backings contributed to improved ruggedness and life for coated abrasives in demanding applications, but militated against straight tear. Many coated abrasives on polyester cloth, which have gained great commercial importance, are too strong for most users to tear by hand at all, and when tearing is possible, it usually does not produce straight and unpuckered edges.

Coated abrasives having arrays of straight and parallel yarns, most often of synthetic multifilament polyester, as their principal backing strength members have more recently gained commercial use. Coated abrasives of this type are described extensively in pending application Ser. No. 06/420,466 filed Sept. 29, 1982. Some stitch bonded fabrics suited to reinforce coated abrasive backings are described in pending application Ser. No. 06/664,446 filed Oct. 23, 1984. Both these applications are assigned to the assignee of the instant application.

These pending commonly assigned applications describe primarily coated abrasives which are very rugged and suited to applications in which mechanical damage to the abrasives and their backings is likely. Such coated abrasives have only limited flexibility and are difficult to use in sanding sharply contoured surfaces. Furthermore, the specific coated abrasives described in examples in these applications were almost all too strong for most potential users to tear easily by hand. If tearing was possible, a straight edge was a rare result.

Resistance to tearing is obviously one component of damage resistance, but there are many applications for coated abrasives in which mechanical damage is fairly unlikely and the convenience of tearing the coated abrasives by hand to yield straight edges is prized by users of the products. Because polyester and other synthetic yarns have other advantages over cotton in addition to superior damage resistance, and because stitch bonded fabrics have considerable cost and other advantages over woven fabrics, it is an object of the present invention to provide coated abrasives, and fabrics therefor, having the advantages of stitch bonding, synthetic yarns, facile conformability to workpieces of almost any shape, and the ability to be torn straight by hand.

SUMMARY OF THE INVENTION

A combination of particular types of stitch bonded fabrics with particular types of finishing adhesives has been found to yield coated abrasives with good conformability and straight tear combined with adequate damage resistance for many practical uses. Specifically, the fabrics used should have (1) an areal density between 51 and 153 grams per square meter (hereinafter $gm/m^2$), (2) a tensile strength in the machine direction between 5.4 and 12.6 kilonewtons per meter (hereinafter kN/m) of width, (3) a tensile strength in the cross direction between 5.4 and 11.7 kN/m of length and is between 0.9 and 1.35 times as great as the machine direction tensile strength, (4) an elongation to break in the machine direction of not more than 40%, and (5) an elongation to break in the cross direction of not more than 35%. It should be noted that the fabrics are often heat set before finishing and that the heat setting usually increases the tensile strength in the machine direction; the figures above are for the greige fabric.

A physical property of the final coated abrasive which has been found critical to assure straight tear is the ratio between the product of the tensile strength and the percentage elongation at break in the machine and cross directions. This product for each direction is defined and denoted herein as the "tensile modulus" for that direction. The final coated abrasive should have a ratio of machine direction tensile modulus to cross direction tensile modulus within the range of 0.8 to 1.8.

BRIEF DESCRIPTION OF THE DRAWINGS

FIGS. 2-A, 2-B, and 2-C collectively represent a more complex type of suitable fabric, which incorporates both chain and tricot stitching yarns and is made on a stitch bonding machine with two guidebars.

DESCRIPTION OF THE PREFERRED EMBODIMENTS

Fabrics

Figure 1:
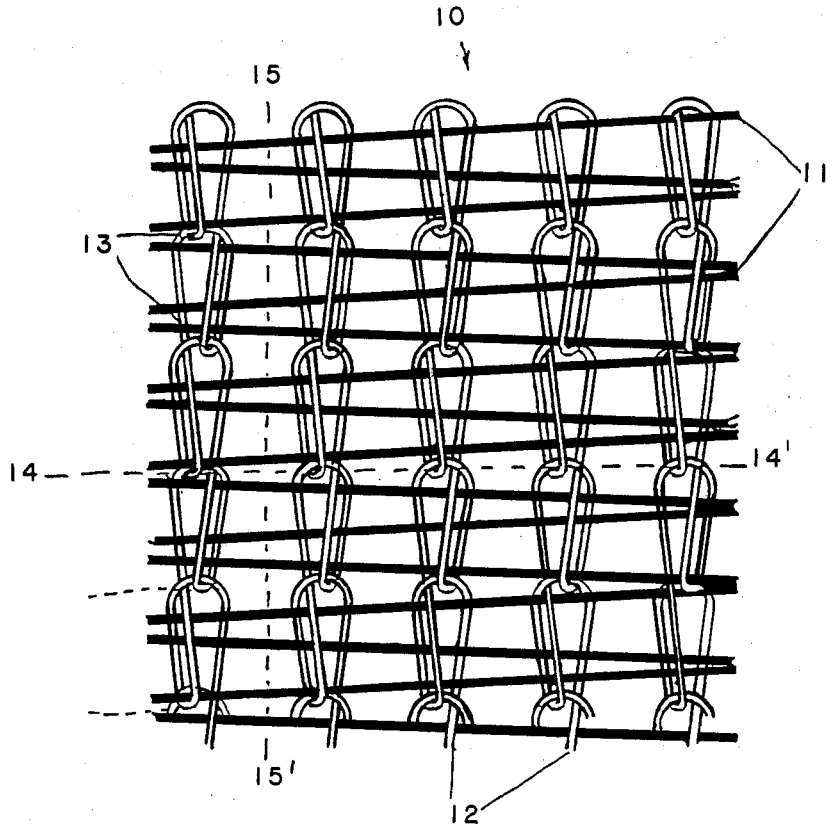
FIG. 1 is a schematic representation of one type of suitable fabric, made on a single guidebar stitch bonding machine, for use in this invention.

The fabrics best suited to the purposes of the present invention include four general types. If only single guidebar stitch bonding machines are used, and the best performance is needed, the preferred fabric design is one with warp yarns, fill yarns, and tricot stitches linking the two. Fabrics of this general type are depicted in application Ser. No. 06/664,446 already noted above. Although there are significant differences in the yarns used for the purposes taught in Ser. No. 664,446 and those taught herein, these differences do not affect a generalized pictorial description of the fabric type, so that fabrics of this first type are not illustrated by any of the drawing figures herein. For making flexible coated abrasives according to the instant invention, preferred fabrics of this type have warp yarns from 150–300 denier in size at a count of 22–14 yarns per 25 mm of fabric width, fill yarns from 55–85 denier in size at a count of from 96–48 per 25 mm of fabric length, and stitch yarns from 55–85 denier in size at the same count as the warp yarns.

The other general type of preferred fabric for this invention which can be made on a single guidebar stitch bonding machine is one which has no warp yarns and instead relies only on the stitching yarns for tensile strength in the machine direction. Although tricot stitching may be used, chain stitching is generally preferred for this type. Stitches made with properly chosen yarn have sufficient tensile strength and stretch resistance for the relatively non-hazardous applications of the coated abrasive products of this invention. These fabrics are more economical than those which contain warp yarns and are preferred for applications of this invention where economy is more important than maximum durability.

A fabric of this economical type is illustrated in FIG. 1. The fabric 10 is comprised of fill yarns 11 and stitch yarns 12. The fill yarns, as shown in the Figure, comprise two subgroups. Yarns within each subgroup are coparallel, but are oriented at a slight angle to the yarns of the other subgroup. In a sufficiently wide sample of the fabric, the yarns of the two subgroups will intersect occasionally across the fabric, but in the narrow sample illustrated in FIG. 1, there are no such intersections, although there are near approaches near the right edge of the Figure.

The knotting of chain stitch yarns at the points of maximum curvature 13 shown in FIG. 1 creates a focus for concentrations of mechanical stresses such as those which produce tearing. Chain stitching, when performed with most commercial stitch bonding machines such as the preferred Malimo machines, produces fabrics in which the hypothetical paths that connect knot points in the yarns with their nearest neighbor knot points in a different yarn are reasonably straight and perpendicular to the general direction of the stitch yarns themselves. The dashed line 14–14' in FIG. 1 is an example of this. Thus, when fabrics of this type are incorporated into coated abrasives as taught below, straight tear across the machine direction of the fabric or abrasive is easier than in fabrics with unknotted warp yarns. With fill yarns that are not too strong, tear along the machine direction, as for example along dashed line 15–15' in FIG. 1, is also easy. For clarity of illustration, the relative size of the spaces between yarns, compared with the size of the yarns themselves, is shown in FIG. 1 to be much larger than it usually is in practice.

For fabrics of the type illustrated in FIG. 1, it is preferred that the fill yarns are from 55–85 denier and present at a count of 96–48 per 25 mm of fabric length and that the stitch yarns are from 70–150 denier and present at a count of 22–14 per 25 mm of fabric width.

In some applications of this invention, more complex fabric constructions available from stitch bonding machines with two guidebars are preferable to either type noted above. Such a complex fabric is illustrated in the three parts of FIG. 2. This fabric comprises four distinct groups of yarns. The first group are chain stitches 22, shown in formalized projection in FIG. 2-A. The second group are tricot stitches 24 shown in projection in FIG. 2-B. The third and fourth groups are straight yarns shown in FIG. 2-C, which represents the full fabric in projection. Warp yarns 23 run straight in the machine direction and fill yarns 21 run straight in the cross direction, or more exactly in two subgroups at slight angles to each other and to the cross direction as shown in FIG. 1. In FIG. 2, this separation of the fill yarns into two subgroups is ignored.

The three parts of FIG. 2 are shown at the same relative scale, and it may be seen in the Figure that the loops of the tricot stitches 24 approximately overlap alternating loops of the chain stitches 22. The warp yarns 23 all lie on one side of the fill yarns 21, but both types of stitch yarns 22 and 24 move back and forth through and outside the two planes defined by the two types of straight yarns. The tricot stitch yarns thus "trap" the warp yarns and hold them against the fill yarns, thereby binding the otherwise unattached warp yarns into the fabric as a whole.

It should be emphasized that all the parts of FIG. 2 show projections in a single plane only, with no attempt to indicate depth. Also, the loops in the stitch yarns in these figures are much exaggerated in size compared to the part of the yarn between the loops. The actual shape of the chain stitch is much closer to that shown in FIG. 1 than in FIG. 2-A.

For the type of fabric illustrated in FIG. 2, the warp yarns are preferably from 150–300 denier and present at a count of from 22–14 per 25 mm of fabric width, the chain stitch yarns are preferably from 55–85 denier and present at the same count as the warp yarns, the fill yarns are preferably from 55–85 denier and are present at a count of from 96–48 per 25 mm of fabric length, and the tricot stitch yarns are from 55–85 denier and present at the same count as the warp yarns.

Figure 3:
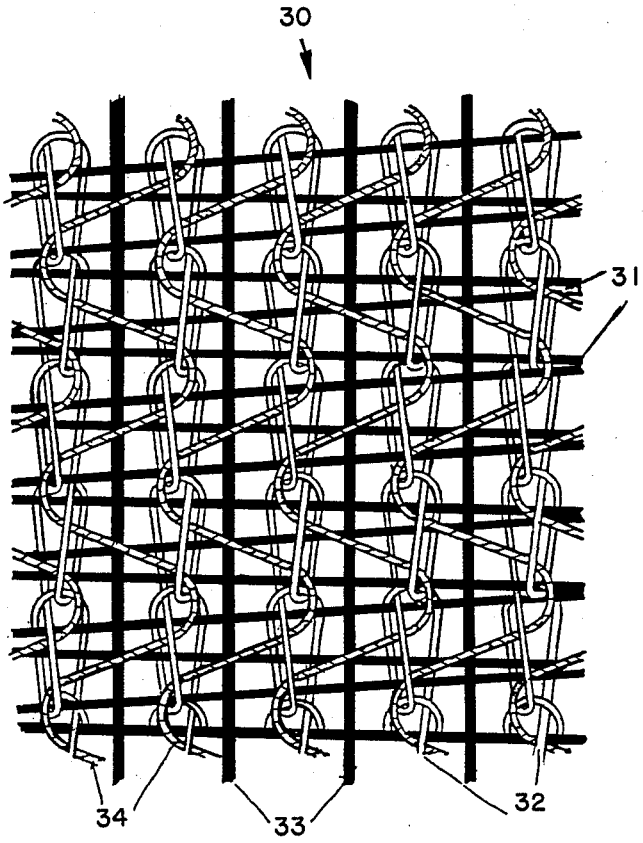
FIG. 3 represents another type of suitable fabric for this invention, made on a two guidebar stitch bonding machine and utilizing laid-in serpentine yarns in the machine direction.

Still another general type of construction, preferred when smoothness is especially important, is illustrated in FIG. 3. Instead of the tricot stitch yarns of the fabric shown in FIG. 2, this has serpentine fill yarns 34. The serpentine fill yarns are put into place in the fabric by alternate stitching needles, but the motion of the needles is altered by changes in parts, as recommended for the purpose by the supplier, so that the yarns undulate in two dimensions between the locations of two nearest neighbor chain stitch yarns but do not form closed loops or penetrate the planes of the warp and fill yarns. Nevertheless, as shown in FIG. 3, because the serpentine yarns 34 are engaged within the loops of the chain stitches 32, and because the warp yarns 23 lie in a plane between the two planes of the fill yarns 31 and the serpentine yarns 34, all four types of yarns are held together in a fabric sufficiently coherent to withstand the stresses of saturation without excessive distortion. The preferred yarn sizes and counts for the type of fabric illustrated in FIG. 3 are the same as for that illustrated in FIG. 2, with the serpentine fill yarns of the former replacing the tricot stitch yarns of the latter.

Any tricot stitch yarns or laid-in serpentine yarns used in fabrics for this invention are sufficiently weak to present no significant obstacle to straight tearing in the finished coated abrasive. For example, 70 denier texturized polyester yarns are often preferred for these stitch or serpentine yarns.

The presence of warp yarns between the chain stitches is believed to promote straightness of tear by a mechanical process analogous to the use of a ruler along one edge of the tear line when tearing finished woven cloth: The warp yarn is sufficiently strong to inhibit any tendency for tearing paths generally parallel to the warp yarn direction to deviate across the line of a warp yarn. On the other hand, the warp yarns are not strong enough to avoid being broken themselves when tearing perpendicular to the warp yarn direction is desired.

As with FIG. 1, the spaces between yarns in FIGS. 2 and 3 are shown larger relative to the yarn sizes than is usually true for actual fabrics.

The distance, along the machine direction, between two successive points of maximum curvature of a looped stitch yarn, such as the two points marked 13 in FIG. 1, is denoted herein as the stitch length. As will be apparent from the discussion above in connection with FIG. 1, the shorter the stitch length, the smoother the torn edge is likely to be when tearing across the machine direction. This desirable effect must be balanced with cost, which increases with decreasing stitch length because less fabric is produced in each cycle of the stitch bonding machine. Stitch lengths between 0.5 and 1.2 mm have generally been found suitable for fabrics for this invention, with a stitch length of 0.8 mm most preferred.

Analogously, a fabric with more numerous warp and stitch yarns per unit of fabric width will normally produce a coated abrasive product with a smoother tear line for tearing along the machine direction. Again there is a balancing consideration: To obtain the same fabric tensile strength with a larger number of finer yarns is generally more expensive. The term "gauge" is well known in the art of stitch bonding to refer to the number of yarns per 25 mm of fabric width. For this invention, fabrics with a gauge from 14–22 are preferred, with 18 gauge generally most preferred.

For all four general types of preferred fabric constructions described above, texturized multifilament polyester yarn is generally preferred because of its optimization of the combination of strength, covering power, and economy. Polyamide (or nylon), polyacrylate, and many other types of yarns are equally suitable for use but generally cost more.

Some specific examples of constructions of suitable fabrics from both one and two guidebar stitch bonding machines are shown in Table 1. The cloth finishing and subsequent processes and materials used to convert the fabrics into the coated abrasive products with the tensile modulus properties shown in Table 1 are specified below.

tion to cross direction tensile strengths of not less than 1.4 and an elongation to break of not more than 35% in the cross direction nor 40% in the machine direction. The primary ingredients of preferred saturants are one or more latices of acrylic homopolymers, acrylic copolymers, butadiene-styrene polymers, or mixtures of these types. These latices should preferably yield cured films with tensile strengths in the range of 6–35 megapasclas per square meter (hereinafter $MPa/m^2$) and elongations to break in the range of 50–500%. Some admixture of these primary ingredients with thermosetting resins which yield considerably stiffer films on cure than do the latices is sometimes preferable. The saturants may be filled with conventional finely ground solids, preferably in the range of filler weights which are 25–50% of the weight of the remainder of the solids content of the saturant. Preferred fillers are calcium carbonate, sodium silicates, or clays.

The large scale method of saturant application preferably varies with the ratio of saturant weight to fabric weight. This ratio preferably lies between 1 and 3. If the ratio is near the upper limit of the preferred range, a metering roll type of coating is preferred. If the ratio is near the middle of the preferred range, a pressure roll or kiss coating technique is preferred, while if the ratio is near the lower end of the preferred range, almost any type of coating is satisfactory, with vertical calender rolls preferred.

For small scale sample preparation, a laboratory method of saturation can be conveniently used. In this method, the fabric is drawn rapidly through a gap between two polished cylindrical steel bars. The gap is set by use of gauges at a specified thickness slightly greater than the fabric thickness, and the gap is filled with an adhesive having sufficient viscosity to resist flowing through the gap under the influence of gravity alone. As an example, the products shown in Table 1 were saturated in this way, using a gap 0.127 mm thicker than the thickness of the fabric as measured at a pressure of 6.6 $kN/m^2$. The saturant formula used was:

| | |
|---|---|
| Gen Flo 8513 | 765 parts |
| Gen Flo 6506 | 254 parts |
| Calcium carbonate | 250 parts |
| 25% aqueous solution of sodium ammonium pyrophosphate | 10 parts |
| Acrysol ASE-60 | 9 parts |
| Imperon Brown CKRN Pigment Dispersion | 11 parts |

TABLE 1

EXAMPLES OF SUITABLE FABRICS FOR THIS INVENTION

| | Yarns Used | | | | | | | | Fabric Physical Properties | | | | | | |
|---|---|---|---|---|---|---|---|---|---|---|---|---|---|---|---|
| | Machine Dir. | | Cross Dir. | | Tricot Stitch | | Chain Stitch | | Tensile Strength, Lbs. per Inch | | | Tensile Modulus | | | Mass, |
| No. | Gage | Denier | Gage | Denier | Gage | Denier | Gage | Denier | Lgth. | Cross | Ratio | Lgth. | Cross | Ratio | $Gm/M^2$ |
| 1 | 18 | 150 | 64 | 70 | 18 | 70 | 18 | 70 | 34.5 | 36.0 | 104 | 337 | 480 | 124 | 97 |
| 2 | 18 | 150 | 96 | 70 | 18 | 70 | 18 | 70 | 35.0 | 47.0 | 134 | 322 | 398 | 89 | 109 |
| 3 | 18 | 300 | 96 | 70 | 18 | 70 | none | | 49.0 | 57.5 | 117 | 350 | 335 | 96 | 95 |
| 4 | none | | 96 | 70 | none | | 18 | 150 | 49.0 | 44.0 | 90 | 256 | 284 | 111 | 97 |

Notes for Table 1

Dir. = Direction; $Gm/M^2$ = grams per square meter; Lbs. = pounds; Lgth. = lengthwise, and means "in the machine direction"; "Gage" under "Machine Dir." or under "Stitch" means number of yarns per 25 mm of fabric width; "Gage" under "Cross Dir." means number of yarns per 25 mm of fabric length; "Tensile Modulus" is defined as the product of tensile strength in kN/m and percentage elongation at breaking strength and is measured on a coated abrasive product rather than on the greige fabric, as are all the other properties shown in the Table; "Ratio" means value of the property concerned for the cross direction as a percentage of the same value for the machine direction.

All fabrics shown in this table were made on a MALIMO Type Malimo stitch bonding machine. All stitch yarns shown in this table were used at 0.8 mm stitch length. All yarns shown in the table were single ply texturized synthetic multifilament regular tenacity polyester, except that the 300 denier yarns shown were made by plying two 150 denier single yarns. All fabric tensile strengths and elongations were measured with 25 mm width fabric strips using an Instron tensile tester.

Cloth Finishing Adhesives and Processes

The fabric to be used is preferably finished with not less than its own weight of a saturant to give a backing ready for coating and having a ratio of machine direc- Among the ingredients in this formulation, the two Gen Flo materials were obtained from the Polymers Division of DiversiTech General, Akron, Ohio. Both are latices of carboxylic-modified butadiene styrene polymer, with solids contents of about 50% and specific gravities of 1.01±0.01. Physical properties of the cured films formed from these latices after drying and exposure to a temperature of 113° C. for six hours are shown in Table 2 below.

TABLE 2

| | Physical Properties of Gen Flo Latex Solids | | | | | |
|---|---|---|---|---|---|---|
| | 100% Modulus, MPa/m² | | Maximum % Elongation | | Tensile Strength at Break, MPa/m² | |
| Latex | 22° C. | 121° C. | 22° C. | 121° C. | 22° C. | 121° C. |
| 8513 | 12.2 | 0.52 | 283 | 293 | 17.1 | 3.1 |
| 6506 | 1.3 | 0.38 | 490 | 216 | 5.4 | 0.56 |

Acrysol ASE-60 is an acrylic thickening agent latex, with about 28% by weight solids, available from Rohm and Haas. The pigment dispersion contained 14% by weight solids and was obtained from American Hoechst Co.

Other Processes and Materials

The making, grain coating, sizing, and adhesive cure processes used were those conventional in the coated abrasive art. Preferred making and sizing adhesives were urea-formaldehyde resins, phenol-formaldehyde resins, melamine-formaldehyde resins, or water-dispersible epoxy resins. The resins may be used with or without appropriate fillers as is conventionally known. Abrasive grits should be adapted in size and type to the work to be done with the coated abrasives, and the amounts of making and sizing adhesives should be adapted to the grit size and the type of work to be done, in the manner conventional for prior art coated abrasives on woven cloth. For example, the products listed in Table 1 had maker and sizer adhesives of conventional urea-formaldehyde resin filled with calcium carbonate.

EXAMPLES

The scope of the invention may be further appreciated from the following additional specific examples.

EXAMPLE 1

The fabric for this example had the construction and properties shown for Fabric 3 in Table 1.

The saturant used had the following formula as applied:

| | |
|---|---|
| Gen Flo 8513 | 765 parts |
| Gen Flo 6506 | 254 parts |
| Calcium carbonate | 250 parts |
| Imperon Brown CKRN Pigment Dispersion | 11 parts |

The calcium carbonate had an average particle size of 13.2 microns. The other ingredients in the formula have been identified above.

These ingredients were mixed in the order listed with constant stirring. The saturant was applied by metering roll and knife so as to produce a smooth deposit, with a dry weight of 145–185 grams per square meter (hereinafter gm/m²) of the fabric, throughout the interstices of the fabric. The wet saturated fabric was held on a tenter frame while passing through an oven with an entrance zone temperature of 93° C. and an exit zone temperature of 218° C. Total exposure time of the wet saturated fabric to the oven was one minute. During the passage through the oven, the tenter clips were maintained at a width which was 10% less than the original greige width of the fabric, and the fabric shrank to that width during the course of drying the saturant. This treatment resulted in a backing ready to accept a maker adhesive without problems of strike through or excessive penetration of the maker into the backing.

The backing prepared as described above was subjected to conventional coating with grit 120 aluminum oxide abrasive. A conventional urea-formaldehyde resin with appropriate latent acid catalyst and calcium sulfate filler at about 40% by volume level was used for both maker and size adhesives.

EXAMPLE 2

The fabric for this example was the one designated as Fabric 4 in Table 1. Before saturation, the fabric was heat set at 218° C. while held on a tenter spaced at the original fabric width.

The heat set fabric was saturated with an adhesive composition similar to that of the saturant of Example 1 by drawing the fabric through an adhesive filled gap between two cylindrical steel bars; the gap was 1 mm wider than the thickness of the fabric as measured at a compression force of 6.6 kN/m². During saturation, the fabric width decreased by 5–10%. The saturated fabric was held on a tenter at the width to which it had naturally shrunk during saturation and dried at 79° C. for fifteen minutes. An add-on dry mass of 162 gm/m² of saturant was applied. The dried saturated cloth was then subjected to making and sizing as in Example 1.

EXAMPLE 3

The fabric was the one designated as Fabric 2 in Table 1. The saturant adhesive formulation was:

| | |
|---|---|
| Gen Flo 8513 | 383 parts |
| Gen Flo 6506 | 127 parts |
| Dur-O-Cryl 820 | 510 parts |
| Calcium carbonate | 250 parts |
| 25% aqueous solution of sodium ammonium pyrophosphate | 10 parts |
| Acrysol ASE-60 | 10 parts |
| Imperon Brown CKRN | 11 parts |

Among these ingredient, Dur-O-Cryl 820 is a self cross-linking acrylic polymer latex supplied by National Starch and Chemical at a solids content of 44–48%. Films from this latex have a tensile strength of approximately 24 MPa/m² and an elongation to break of approximately 50%. The other tradenamed ingredients have already been identified.

These ingredients were mixed in the order listed with stirring continuing throughout each addition. Saturant was applied by the same method as in Example 2 to give a dry add-on mass of 182 gm/m². The saturated backing was dried on a tenter for 20 minutes at 79° C. Making and sizing on the dried saturated backing then proceeded as in Example 1.

EXAMPLE 4

For this example the fabric was the one designated as Fabric 2 in Table 1. The saturant formulation was:

| | |
|---|---|
| Gen Flo 8513 | 600 parts |

-continued

| | |
|---|---|
| Gen Flo 6506 | 300 parts |
| Cymel 481 | 100 parts |
| Calcium carbonate | 250 parts |
| Imperon Brown CKRN | 11 parts |
| 25% aqueous solution of sodium ammonium pyrophosphate | 10 parts |
| Acrysol ASE-60 | 18 parts |
| Water | 50 parts |

Among these ingredients, Cymel 481 is a methylolated melamine-formaldehyde resin supplied by American Cyanamid. The ingredients were mixed in the order listed to yield a saturant mixture with a pH of 6.1 and a viscosity of about 6,500 centipoises (cp). The saturant was applied and dried by the same techniques as in Example 3 to give a dry add on weight of 185 gm/m$^2$. Making, grain coating, and sizing were completed as in Example 3.

The presence of a thermosetting amino resin in the saturant formulation of this example produced a stiffer and more aggressively cutting product than those from the earlier examples.

EXAMPLE 5

The fabric for this example was that designated as No. 3 in Table 1. The saturant formulation was:

| | |
|---|---|
| Varcum 5868 | 100 parts |
| Ethyl alcohol (commercial grade) | 35 parts |
| Gen Flo 8513 | 600 parts |
| Gen Flo 6506 | 300 parts |
| 25% aqueous solution of ammonium hydroxide | 5 parts |
| Acrysol ASE-60 | 70 parts |
| Water | 50 parts |

Varcum 5868 is a sodium hydroxide catalyzed resole phenolic resin with 73% ultimate solids content and a molar ratio of formaldehyde to bisphenol-A of about 1.5. The ingredients were mixed in the order listed to yield a formulation with a pH of about 6 and a viscosity of about 8,750 cp. Saturant application and drying by the same methods as in Example 4 to produce a saturant add-on weight of 185 gm/m$^2$ were performed on the fabric, and the saturated backing was then made into a coated abrasive by the same steps as in Example 4. The resulting product had about the same stiffness and aggressiveness of cut as the one from Example 4.

EXAMPLE 6

This example is like Example 1, except that conventional resole phenolic resins (sodium catalyzed with formaldehyde to phenol molar ratios of about 1.5) were used for the maker and size adhesives instead of the urea-formaldehyde resins used in Example 1.

EXAMPLE 7

For this example, the fabric was that designated as No. 2 in Table 1 and the saturant composition and amount the same as for Example 1. The maker adhesive had the following composition:

| | |
|---|---|
| CMD 35201 | 480 parts |
| Cymel 481 | 480 parts |
| AMP-95 | 5 parts |
| 25% aqueous solution of $NH_4Cl$ | 12 parts |
| Water | 15 parts |

AMP-95 is a 95% by weight solution of 2-amino-2-methylpropanol in water. CMD 35201, available from Celanese Corp., is a water-dispersed bisphenol-A based epoxy resin with a molecular weight per epoxide group of about 635 and a particle size of about 5 microns. Other ingredients have been previously identified.

The dry maker add on weight was about 78 gm/m$^2$. Grit 120 aluminum oxide at a weight of about 311 gm/m$^2$ was applied into the wet maker by conventional electrostatic upward propulsion. The maker was cured by successive exposure to 77° C. for 24 minutes, 88° C. for 24 min., 99° C. for 15 min., and 24 min. at 113° C.

After maker cure, the product was sized with a conventional calcium carbonate-filled, sodium-catalyzed resole phenolic resin with a formaldehyde to phenol molar ratio of about 1.5. The dry add-on weight of sizer adhesive was about 187 gm/m$^2$. The sized product was preliminarily cured by exposure of the web in festoons to 54° C. for 24 min., 60° C. for 24 min., 88° C for 17 min., 93° C. for 24 min., and 113° C. for 14 min. The entire product was then rolled while still hot and cured in roll form for 4 hours at 113° C.

EXAMPLE b 8

The fabric was that designated as no. 3 in Table 1. The saturant formulation was the same as for Example 1, and the saturant dry add-on weight was 262 gm/m$^2$. The maker formulation was the same as for Example 7, except for the addition of 15 parts of water to the other ingredients listed for Example 7, and the dry weight of maker was 106 gm/m$^2$. The sizer adhesive formulation and curing conditions were the same as for Example 7. The sizing adhesive add-on weight was 101 gm/m$^2$ dry.

EXAMPLE 9

For this example, the fabric was that designated as No. 3 in Table 1. The saturant formula was:

| | |
|---|---|
| CMD 35201 | 480 parts |
| Cymel 481 | 480 parts |
| Calcium sulfate filler | 300 parts |
| AMP-95 | 5 parts |
| 25% aqueous solution of $NH_4Cl$ | 12 parts |
| Imperon Brown Pigment Dispersion CKRN | 11 parts |

The saturant add-on weight was 262 gm/m$^2$ dry. The abrasive grits, maker and sizing adhesives compositions and amounts, and the product cures were all the same as for Example 1.

EXAMPLE 10

The fabric used for this example was composed of only fill and chain stitch yarns. There were 96 fill yarns, each of 70 denier multifilament polyester, per 25 mm of fabric length and 14 chain stitch yarns, each 70 denier texturized multifilament polyester, per 25 mm of fabric width. Before saturation, the fabric was heat set at 218° C. for 4.5 minutes and calendered under a pressure of 180 KPa/m of width at a temperature of 104° C.

The saturant formula was:

| | |
|---|---|
| Gen Flo 8513 | 1969 parts |
| Gen Flo 6506 | 608 parts |
| Calcium carbonate | 312 parts |
| Acrysol ASE-60 | 30 parts |
| Imperon Brown CKRN | 16 parts |

The saturant was applied using a metering knife and roll with two smoothing knives to give a dry deposit of about 127 gm/m$^2$. The maker resin used was a mixture of 711 parts of Resinox 7451 with 267 parts of water. (Resinox 7451, which has about 75% included ultimate solids, is a phenolic laminating resin in methanol available from Monsanto Chemical Co., St. Louis, Mo.) A maker weight equivalent to 63 gm/m$^2$ dry was used, and grit 120 aluminum oxide abrasive grits at a mass of about 132 gm/m$^2$ was coated into the wet maker, which was then cured for about 5 min at 149° C. The grits were then overlaid with a sizer adhesive made by mixing 455 parts of Resinox 7451 with 114 parts of water and 17 parts of Imperon Brown CKRN. The sizer adhesive mass was about 7.7 lbs/ream dry, after cure for four hours at 149° C.

Comparative Testing

The products as described above were compared in a laboratory grinding test to prior art products tor similar uses. One type of prior art product, designated herein as "Control #1", had a backing comprising 2×1 twill weave staple cotton yarns with 23's warp yarns at a count of 84 per 25 mm and 25's fill yarns at a count of 56 per 25 mm. The fabric weighed approximately 163 gm/m$^2$. It was backfilled with a mixture of starch, glue, and clay and then frontsized with glue as conventional in the coated abrasive art. A filled glue maker adhesive, followed by brown aluminum oxide abrasive grits and a urea-formaldehyde resin based sizer adhesive similar to those for Example 1 above were coated on this backing.

For the second type of prior art backing, designated herein as "Control #2", the fabric had the same type of yarns as for Control #1 but a count of 96 per 25 mm warps and 64 per 25 mm fills, with a fabric weight of about 187 gm/m$^2$. The backfill, frontsize, maker adhesive, abrasive grits, and sizer adhesive were all essentially identical to those used for Control #1, except that the frontsize contained starch as well as glue in a ratio of about 3:10.

The two control products and many of those produced by the examples detailed above were cut into rectangular sheets and the sheets tested in a standardized laboratory test procedure in grinding and finishing aluminum and copper workpieces. Test conditions were the same for all sheets and were within the large range of expected actual applications for flexible products of the type described herein. The amount of metal removed and the finish produced on the workpiece during the test interval were measured. The resulting data are shown in Table 3 below.

Under the conditions of Table 3, Example 1 would normally be favored because of the combination of rapid cut and fine surface finish, but any of the other examples might be preferred under different conditions of use.

TABLE 3

Comparison of Cut and Finish Between Products of This Invention and Prior Art Coated Abrasives

| Product | Percentage of Cut, Relative to Control #1 | | Workpiece Finish, Microns AA | |
|---|---|---|---|---|
| Identification | Copper | Aluminum | Copper | Aluminum |
| Control 1 | 100 | 100 | 1.57 | 1.52 |
| Control 2 | 92 | 83 | 2.34 | 2.11 |
| Example 1 | 127 | 102 | 1.55 | 1.55 |
| Example 2 | 119 | 90 | 2.31 | 2.03 |
| Example 3 | 92 | 95 | 1.91 | 2.49 |
| Example 4 | 104 | 105 | 1.83 | 2.72 |

TABLE 3-continued

Comparison of Cut and Finish Between Products of This Invention and Prior Art Coated Abrasives

| Product | Percentage of Cut, Relative to Control #1 | | Workpiece Finish, Microns AA | |
|---|---|---|---|---|
| Identification | Copper | Aluminum | Copper | Aluminum |
| Example 5 | 92 | 97 | 2.08 | 2.46 |
| Example 6 | 91 | 89 | 1.96 | 2.16 |
| Example 7 | 92 | 111 | 1.88 | 2.21 |
| Example 9 | 108 | 104 | 2.49 | 2.31 |
| Example 10 | 88 | 132 | — | — |

What is claimed is:

1. A stitch bonded fabric comprising stitch yarns oriented in the machine direction and fill yarns oriented in the cross direction, said fabric having an areal density between 51 and 153 gm/m$^2$, a tensile strength in the machine direction between 5.4 and 12.6 kN/m of width, a tensile strength in the cross direction which is between 5.4 and 11.7 kN/m of length and is between 0.9 and 1.35 times as great as the machine direction tensile strength, an elongation to break in the machine direction of not more than 40%, and an elongation to break in the cross direction of not more than 35%.

2. A fabric according to claim 1, wherein said stitch yarns are chain stitch yarns.

3. A fabric according to claim 2, wherein all of said yarns are texturized multifilament polyester yarns and said fill yarns are from 55–85 denier and present at a count of 48–96 per 25 mm of fabric length, said stitch yarns are from 70–150 denier and are present at a count of 14–22 per 25 mm of fabric width, and the stitch length is from 0.5 to 1.2 mm.

4. A fabric according to claim 1, wherein said stitch yarns are tricot in pattern, said fabric further comprising warp yarns in the machine direction at the same count as said stitch yarns.

5. A fabric according to claim 4, wherein all of said yarns are texturized multifilament polyester yarns and said fill yarns are from 55–85 denier and present at a count of 48–96 per 25 mm of fabric length, said stitch yarns are from 55–85 denier and are present at a count of 14–22 per 25 mm of fabric width, said warp yarns are from 150–300 denier, and the stitch length is from 0.5 to 1.2 mm.

6. A fabric according to claim 2, further comprising:

(a) straight laid in warp yarns in the machine direction between each pair of chain stitch yarns; and (b) tricot stitch yarns interlacing with said fill yarns and said warp yarns.

7. A fabric according to claim 6, wherein all of said yarns are texturized multifilament polyester yarns, said warp yarns are 150–300 denier and are present at a count of 14–22 per 25 mm of fabric width, said chain stitch yarns are 55–85 denier and are present at a count of 14–22 per 25 mm of fabric width, said fill yarns are 55–85 denier and are present at a count of 48–96 per 25 mm of fabric length, and said tricot stitch yarns are 55–150 denier and are present at a count of 14–22 per 25 mm of fabric width.

8. A fabric according to claim 2, further comprising:

(a) straight laid in warp yarns in the machine direction between each pair of chain stitch yarns; and (b) laid in substantially coplanar serpentine yarns on the opposite side of said warp yarns from said fill yarns, said serpentine yarns being held within alternate loops of two adjacent chain stitch yarns.

9. A coated abrasive product, comprising:

(a) a fabric according to claim 8;
(b) a saturant which fills the interstices of said fabric and is present in an amount not less than the weight of said fabric;
(c) a plurality of abrasive grits, which are adhered by a maker adhesive to one major surface ot the backing formed by said fabric and said saturant and are substantially uniformly distributed over said major surface; and
(d) a size adhesive which covers and adheres to said abrasive grits, said coated abrasive having the property of straight tear in both length and cross directions of said coated abrasive, said coated abrasive further having a ratio of tensile modulus in the machine direction to tensile modulus in the cross direction in the range between 0.8 and 1.8.

10. A coated abrasive product, comprising:
(a) a fabric according to claim 7;
(b) a saturant which fills the interstices of said fabric and is present in an amount not less than the weight of said fabric;
(c) a plurality of abrasive grits, which are adhered by a maker adhesive to one major surface of the backing formed by said fabric and said saturant and are substantially uniformly distributed over said major surface; and
(d) a size adhesive which covers and adheres to said abrasive grits, said coated abrasive having the property of straight tear in both length and cross directions of said coated abrasive, said coated abrasive further having a ratio of tensile modulus in the machine direction to tensile modulus in the corss direction int the range between 0.8 and 1.8.

11. A coated abrasive product, comprising:
(a) a fabric according to claim 6;
(b) a saturant which fills the interstices of said fabric and is present in an amount not less than the weight of said fabric;
(c) a plurality of abrasive grits, which are adhered by a maker adhesive to one major surface of the backing formed by said fabric and said saturant and are substantially uniformly distributed over said major surface; and
(d) a size adhesive which covers and adheres to said abrasive grits, said coated abrasive having the property of straight tear in both length and cross directions of said coated abrasive, said coated abrasive further having a ratio of tensile modulus in the machine direction to tensile modulus in the cross direction in the range between 0.8 and 1.8.

12. A coated abrasive product, comprising:
(a) a fabric according to claim 5;
(b) a saturant which fills the interstices of said fabric and is present in an amount not less than the weight of said fabric;
(c) a plurality of abrasive grits, which are adhered by a maker adhesive to one major surface of the backing formed by said fabric and said saturant and are substantially uniformly distributed over said major surface; and
(d) a size adhesive which covers and adheres to said abrasive grits, said coated abrasive having the property of straight tear in both length and cross directions of said coated abrasive, said coated abrasive further having a ratio of tensile modulus in the machine direction to tensile modulus in the cross direction in the range between 0.8 and 1.8.

13. A coated abrasive product, comprising:
(a) a fabric according to claim 4;
(b) a saturant which fills the interstices of said fabric and is present in an amount not less than the weight of said fabric;
(c) a plurality of abrasive grits, which are adhered by a maker adhesive to one major surface of the backing formed by said fabric and said saturant and are substantially uniformly distributed over said major surface; and
(d) a size adhesive which covers and adheres to said abrasive grits, said coated abrasive having the property of straight tear in both length and cross directions of said coated abrasive, said coated abrasive further having a ratio of tensile modulus in the machine direction to tensile modulus in the cross direction in the range between 0.8 and 1.8.

14. A coated abrasive product, comprising:
(a) a fabric according to claim 3;
(b) a saturant which fills the interstices of said fabric and is present in an amount not less than the weight of said fabric;
(c) a plurality of abrasive grits, which are adhered by a maker adhesive to one major surface of the backing formed by said fabric and said saturant and are substantially uniformly distributed over said major surface; and
(d) a size adhesive which covers and adheres to said abrasive grits, said coated abrasive having the property of straight tear in both length and cross directions of said coated abrasive, said coated abrasive further having a ratio of tensile modulus in the machine direction to tensile modulus in the cross direction in the range between 0.8 and 1.8.

15. A coated abrasive product, comprising:
(a) a fabric according to claim 2;
(b) a saturant which fills the interstices of said fabric and is present in an amount not less than the weight of said fabric;
(c) a plurality of abrasive grits, which are adhered by a maker adhesive to one major surface of the backing formed by said fabric and said saturant and are substantially uniformly distributed over said major surface; and
(d) a size adhesive which covers and adheres to said abrasive grits, said coated abrasive having the property of straight tear in both length and cross directions of said coated abrasive, said coated abrasive further having a ratio of tensile modulus in the machine direction to tensile modulus in the cross direction in the range between 0.8 and 1.8.

16. A coated abrasive product, comprising:
(a) a fabric according to claim 1;
(b) a saturant which fills the interstices of said fabric and is present in an amount not less than the weight of said fabric;
(c) a plurality of abrasive grits, which are adhered by a maker adhesive to one major surface of the backing formed by said fabric and said saturant and are substantially uniformly distributed over said major surface; and
(d) a size adhesive which covers and adheres to said abrasive grits, said coated abrasive having the property of straight tear in both length and cross directions of said coated abrasive, said coated abrasive further having a ratio of tensile modulus in the machine direction to tensile modulus in the cross direction in the range between 0.8 and 1.8.

17. A coated abrasive according to claim 16, wherein said saturant comprises the product of drying a synthetic latex selected from the group consisting of polyacrylates, acrylic copolymers, butadiene-styrene polymers, and mixtures thereof.

18. A coated abrasive according to claim 14, wherein said saturant comprises the product of drying a synthetic latex selected from the group consisting of polyacrylates, acrylic copolymers, butadiene-styrene polymers, and mixtures thereof.

19. A coated abrasive according to claim 12, wherein said saturant comprises the product of drying a synthetic latex selected from the group consisting of polyacrylates, acrylic copolymers, butadiene-styrene polymers, and mixtures thereof.

20. A coated abrasive according to claim 11, wherein said saturant comprises the product of drying a synthetic latex selected from the group consisting of polyacrylates, acrylic copolymers, butadiene-styrene polymers, and mixtures thereof.

* * * * *